US005277621A

United States Patent [19]

Seto

[11] Patent Number: 5,277,621

[45] Date of Patent: Jan. 11, 1994

[54] ELECTRIC CONNECTOR TERMINAL MOUNT

[75] Inventor: Masashi Seto, Zama, Japan

[73] Assignee: Molex Incorporated, Lisle, Ill.

[21] Appl. No.: 973,360

[22] Filed: Nov. 9, 1992

[51] Int. Cl.[5] ..... H01R 13/00

[52] U.S. Cl. ..... 439/493

[58] Field of Search ..... 439/67, 77, 492–499, 439/629–637

[56] References Cited

U.S. PATENT DOCUMENTS

| | | | |
|---|---|---|---|
| 3,737,833 | 6/1973 | Jerominek | 439/493 |
| 3,923,364 | 12/1975 | Shapiro et al. | 439/493 |
| 4,861,272 | 8/1989 | Clark | 439/493 |
| 4,959,030 | 9/1990 | Tatebe et al. | 439/493 |

OTHER PUBLICATIONS

Unexamined Utility Model Publication H3-26979 (Fujitsu Co.) Mar. 19, 1991.

*Primary Examiner*—Joseph H. McGlynn
*Attorney, Agent, or Firm*—Stephen Z. Weiss

[57] ABSTRACT

Disclosed is an improved electrical connector terminal mount which has an engagement piece integrally formed in the terminal base. The engagement piece functions to fix the terminal in an associated terminal slot. The engagement piece is a metal strip cut away from the base of the terminal in the form of flattened "V"-shaped cantilever arm. The metal strip consists of a first section bent outward on one side of the base of the terminal and a second section integrally connected to and extending inward from the end of the first section toward the other side of the base of the terminal ending in a free end. An engagement slot perpendicular to the terminal slot is formed within which the engagement piece fits, thereby enabling the terminal to fixedly lie along the center line of the terminal slot and to prevent the vertical movement of the terminal out of the terminal slot.

3 Claims, 5 Drawing Sheets

FIG.7
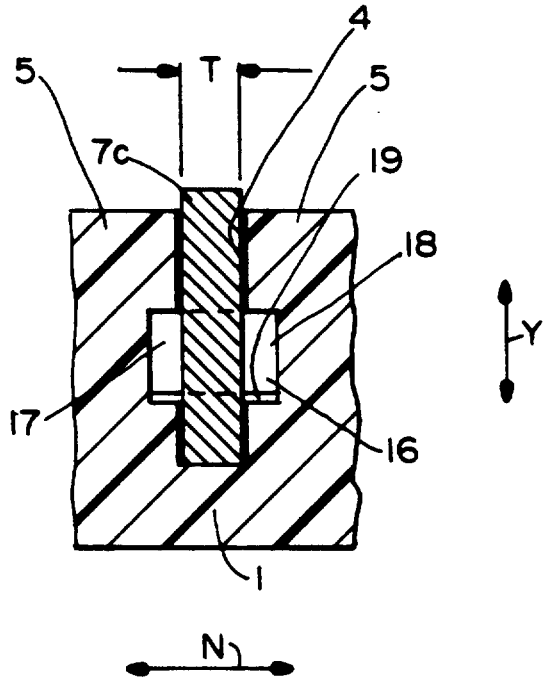
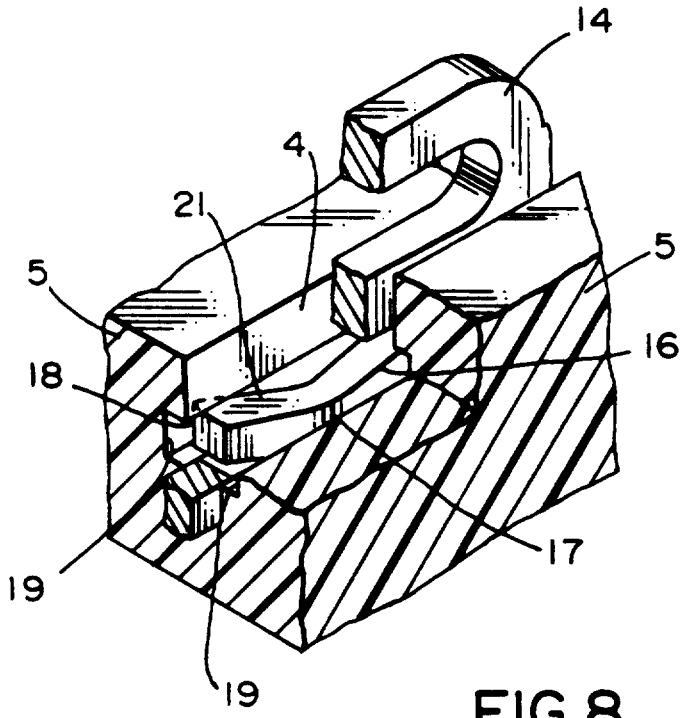
FIG.8

ELECTRIC CONNECTOR TERMINAL MOUNT

FIELD OF THE INVENTION

The present invention relates to an improvement in means for mounting terminals in associated terminal slots in the housing of an electric connector.

BACKGROUND OF THE INVENTION

As is well known, a conventional electric connector comprises a housing having a plurality of terminal slots made therein and a corresponding plurality of terminals mounted in the terminal slots. It is desired that terminals are immovably mounted in the associated slots, thereby preventing the tilting of terminals or vertical displacement of the terminals in the housing slots while the electric connector is used. To mount the terminal, an end of the terminal base is inserted from the front end into the rear end of the housing. The inserted terminal end has at least one laterally extending projection or barb which skives into a slot in the rear end of the housing. The trailing end of the terminal is inserted into a slot in the front housing end.

This connector structure, however, has some defects. When the terminals of a printed circuit board or the conductors of the printed circuit board are repeatedly mated with or inserted in the trailing terminal portion, the terminals tilt or are lifted out of the slip fit slot resulting in misalignment with conductors on the printed circuit board or off-center contact with terminals on the printed circuit board. A deteriorated or incomplete electrical and mechanical connection results.

SUMMARY OF THE INVENTION

In view of the above one object of the present invention is to provide an electric connector terminal mount guaranteed free of such off-center and vertical displacement in associated terminal slots of the housing, thus assuring good electrical and mechanical connection of the connector terminals to conductive traces on associated printed boards or terminals extending therefrom.

To attain this object, an electric connector is provided to connect selected traces or terminals on a printed circuit board with selected conductors on a flat flexible cable a housing having a front side and a rear side and having a plurality of terminal slots made therein passing between the front and rear sides and a corresponding plurality of terminals slip fit in the terminal slots from the front side of the housing. Each terminal has a base with an engagement piece stamped therein to be caught by a corresponding engagement slot perpendicular to the terminal slot. The engagement piece is a metal strip cut away from the base of each terminal, having a first and second surface, in the form of flattened "V"-shaped cantilever arm. The engagement piece consists of a first section bent outward from a first surface of the terminal base extending a set distance from said first surface and a consecutive second section integrally connected to and extending from the end of said first section through said base beyond the second surface of the terminal base ending in a free end. The free end extends the same set distance from the second surface of the base as the first section extends from the first surface of the base. The engagement slot extends in a direction equal from both sides of the terminal slot, thereby enabling each terminal to fixedly lie along the center line of the terminal slot wit the first-to-second section transition of the engagement piece and the free end of said second section fit in the engagement slot.

A further improvement to the novel connector includes the terminal base having first and second portions extending in opposite directions The first base portion having said engagement piece stamped therein and the second base portion having a protrusion on its edge which is forced into the top portion of said terminal slot thereby preventing the removal of the terminal out of the terminal slot. Another improvement to the novel connector includes a terminal having first and second contact arms extending from a center portion of the base in opposite directions generally parallel to the base. The first contact arm has a contact point on its free end extending toward the first base portion for contacting a selected terminal or circuit path on a printed circuit board and said second contact arm having a contact point on its free end extending toward the second base portion for contacting a selected conductor of a flat flexible cable.

With these arrangements, each terminal is held at two points in the horizontal plane contacting the sides of the engagement slot, thereby preventing off-center horizontal displacement of the terminals in the slip fit terminal slots of the housing of the electric connector. Thus, each terminal is assured to be held in an associated terminal slot within the center line of the terminal slot. The terminal is also held at two opposite points in the vertical plane contacting the top of the engagement slot, thereby preventing the terminal from raising above a predetermined vertical displacement while being held in the slip fit terminal slot.

BRIEF DESCRIPTION OF THE DRAWINGS

The features of this invention which are believed to be novel are set forth with particularity in the appended claims The invention, together with its objects and the advantages thereof, may be best understood by reference to the following description taken in conjunction with the accompanying drawings in which like reference numerals identify like element figures and in which:

FIG. 7 is a cross section of the electric connector taken along the line 7—7 of FIG. 5;

FIG. 8 is a breakaway perspective section of the engagement piece or arm as it cooperates with the engagement slot.

DETAILED DESCRIPTION OF THE PREFERRED EMBODIMENT

Figure 1:
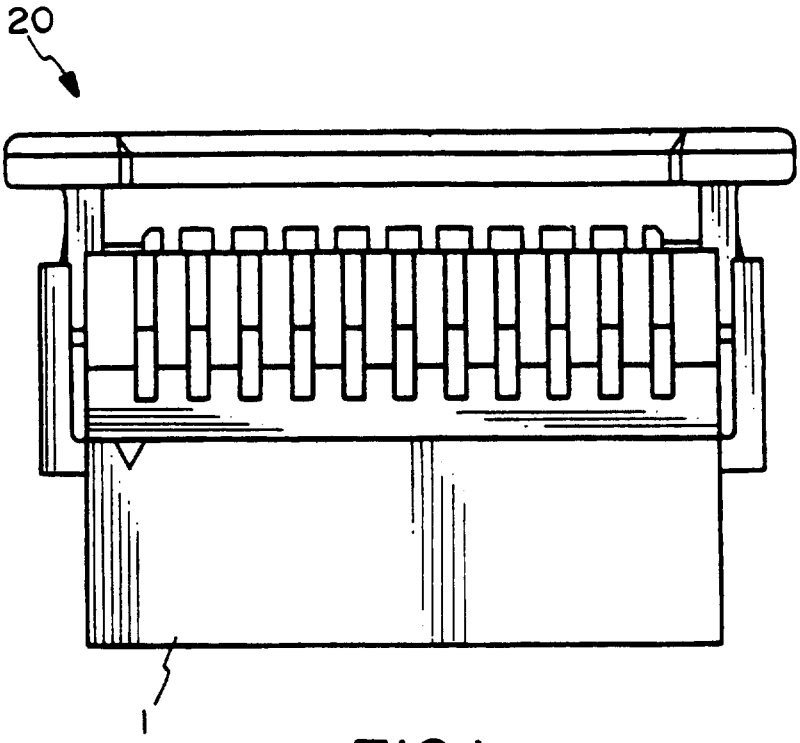
FIG. 1 is a plan view of the electric connector.
Figure 2:
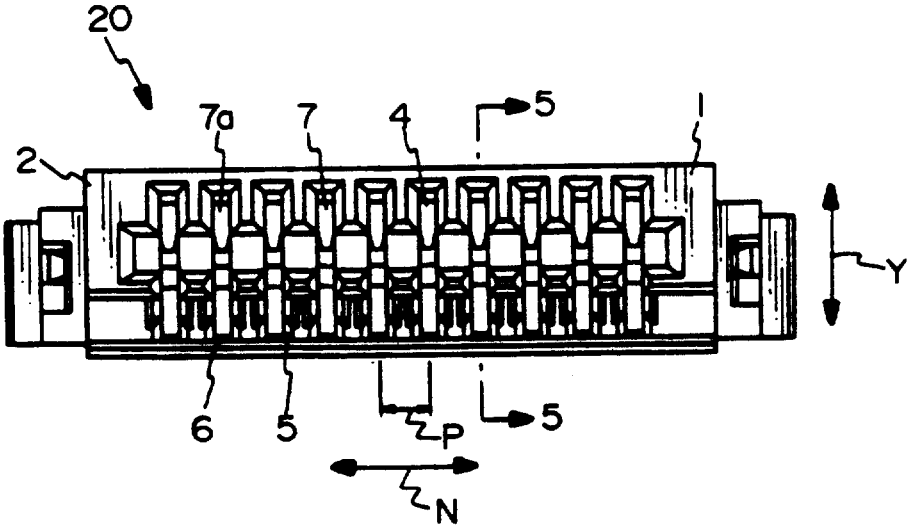
FIG. 2 is a front view of the electric connector.
Figure 3:
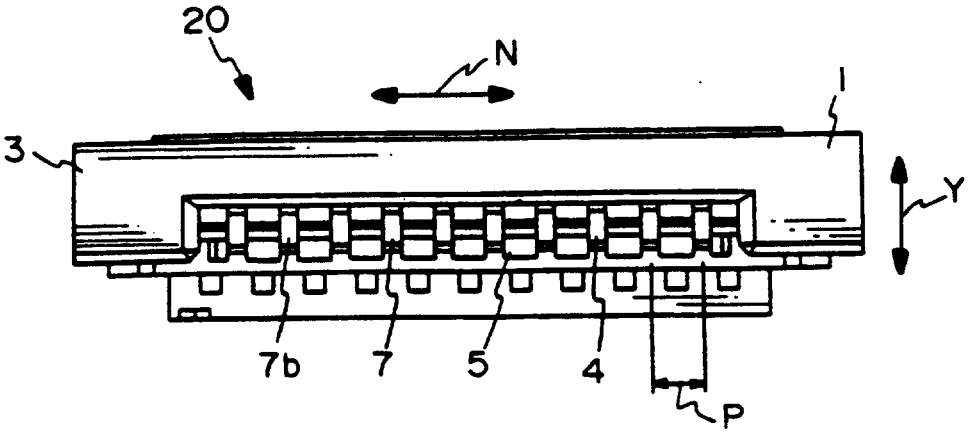
FIG. 3 is a rear view of the electric connector.
Figure 4:
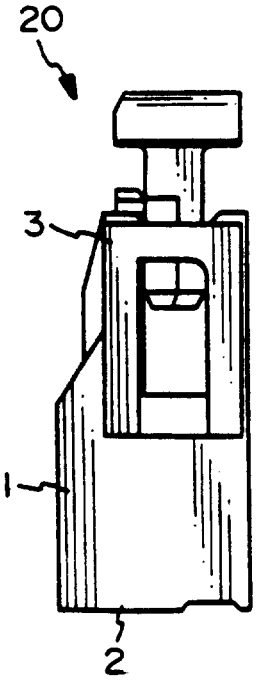
FIG. 4 is a right side view of the electric connector.

As shown in the drawings, an electric connector generally referred to as 20 to a preferred embodiment of the present invention comprises a housing 1 having a plurality of terminal slots 4 made therein and a corresponding plurality of terminals 7 mounted in the terminal slots 4. Specifically, each terminal slot 4 extends from the front side 2 to rear side 3 of the housing 1. All terminal slots are arranged at a predetermined regular interval or pitch laterally in the direction "N", and an intervening wall 5 is arranged between adjacent terminal slots 4. As is best seen from FIG. 5, each terminal 7 has a projection 9*a* on its base 15 to be caught by a groove 8, which is made on the bottom of an associated terminal slot, thereby permitting the terminal 7 to be fixed at a predetermined position in the terminal slot 4 when the terminal 7 is inserted therein.

Figure 5:
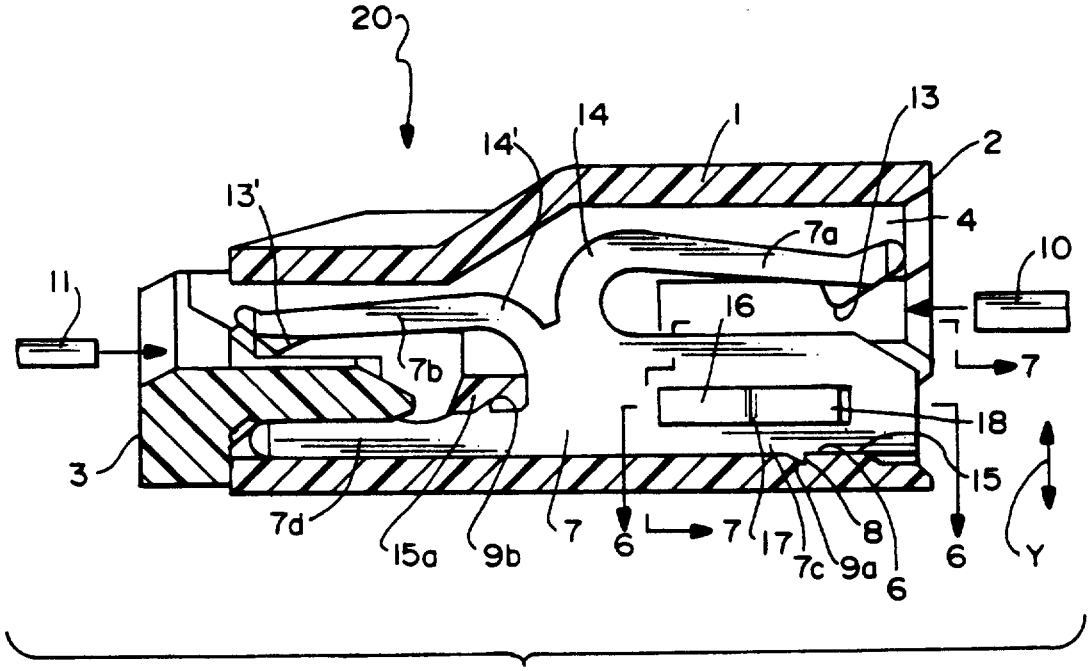
FIG. 5 is a longitudinal section of the electric connector taken along the line 5—5 of FIG. 2.
Figure 6:
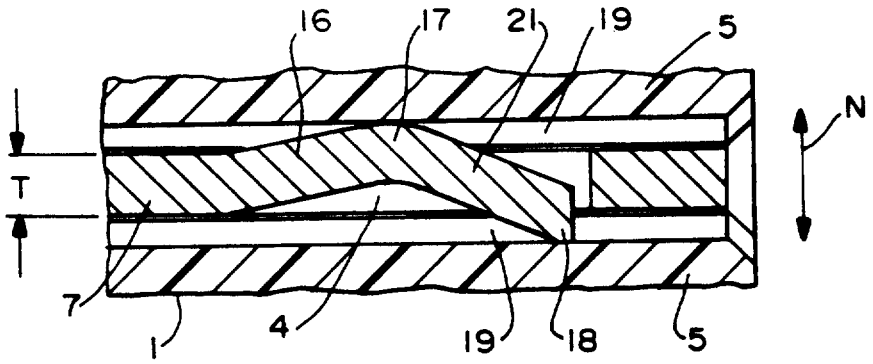
FIG. 6 is a longitudinal section of the electric connector taken along line 6—6 of FIG. 5.
Figure 9:
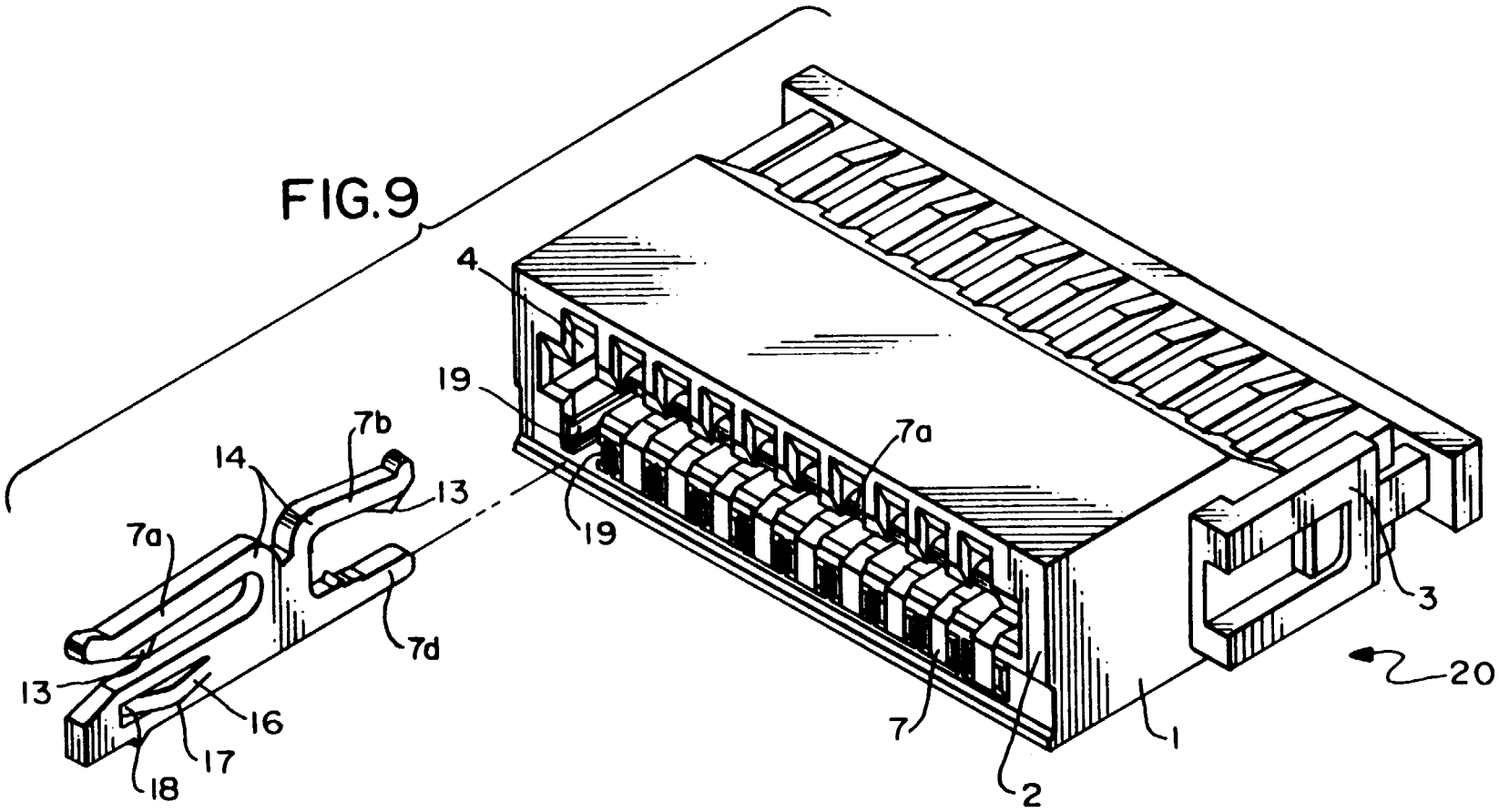
FIG. 9 is a perspective section of all but one of the terminals inserted into the housing.

Also, as seen from FIG. 5, each terminal 7 is stamped as an integral metal piece comprising a first resilient contact arm 7*a* extending in one direction, a second resilient contact arm 7*b* extending in the other direction, and an elongated base consisting of portions 7*c* and 7*d* extending parallel to the first and second contact arms 7*a* and 7*b*. The first contact arm 7*a* is integrally connected to the base at its curved root 14 and has a contact point 13 on its free end for contacting a selected terminal or circuit trace on a printed circuit board 10. Likewise, the second contact arm 7*b* is integrally connected to the base at its curved root 14', and the second contact arm 7*b* has a contact point 13' on its free end for contacting a selected conductor of a flat, flexible cable 11. The terminal base portion 7*d* is mounted in the slip fit terminal slot 7 with a force fit created between the housing base 15 and housing middle wall 15*a* as a result of projection 9*b* extending outward from the terminal edge. This extending projection 9*b* skives into the edge of the terminal slot preventing the terminal base portion 7*d* from being withdrawn from the terminal slot 7.

Terminal 7 has an engagement piece 16 integrally formed from base portion 7*c* generally parallel with the first contact arms 7*a*. The engagement piece 16 functions to fix the terminal 7 in an associated terminal slot 4 as described later. The terminal 7 is stamped out and formed from a metal sheet whose thickness dimension "T" is somewhat smaller than the width of the terminal slot 4 creating a slip fit relation between the terminal 7 and the terminal slot 4.

The engagement piece 16 is a metal strip stamped from and integral with the base portion 7*c* of the terminal in the form of flattened "V"-shaped cantilever arm. The metal strip consists of a first section 16 bent outward on one side of the terminal base 7*c* and a second section 21 integrally connected to and extending inward from the end 17 of the first section 16, said end 17 defining a transition between the first section 16 and the second section 21 toward the other side of the terminal base 7*c* and ending at the free end 18 of second section 21. An engagement slot 19 is formed in each of the opposite walls 5 of each terminal slot 4, thereby enabling the transition 17 and the free end 18 of the engagement piece 16 to fit in opposite sides of the engagement slot 19 of the terminal slot 4.

As described so far, the terminal housing 1 has terminal 7 mounted in its terminal slots 4, positively holding each terminal 7 by allowing its engagement piece 16 to be caught by its bent transition position 17 and its free end portion 18 in the engagement slot 19 on opposite sides of the terminal slot 4. The terminal pins of a printed circuit board 10 or electrical traces on the circuit board 10 are inserted in the terminal slots 4 of the front side 2 of the housing 1. The conductors of a flat, flexible cable 11 are inserted in the terminal slots 4 of the rear side 3 of the housing 1. The contact arms 7*a* grip resiliently the pin terminals or the circuit traces on the printed circuit board 10, thereby making a necessary electrical connection between the printed circuit board 10. Each terminal is held in an associated terminal slot with the bent transition and free end portions 17 and 18 of its engagement piece 16 caught in the engagement slot 19 on opposite sides of the terminal slot, thereby preventing the terminal 7 from being moved toward either side relative to the center line of the terminal slot 4 or being displaced in a vertical direction Y.

As described earlier, the engagement piece 16 is cut away and bent from the base of the terminal in the form of a flattened "V"-shape cantilever arm. This configuration is simple, and can be easily formed compared with two or more pieces stamped out and formed in either side of the terminal.

It will be understood that the invention may be embodied in other specific forms without departing from the spirit or central characteristics thereof. The present examples and embodiments, therefore, are to be considered in all respects as illustrative and not respective, and the invention is not to be limited to the details given herein.

We claim:

1. An electrical connector designed to connect selected traces or terminals on a printed circuit board with selected conductors on a flat flexible cable comprising:

a housing (1) having a front side (2) and a rear side (3) and having a plurality of terminal slots (4) made therein passing between the front and rear sides and a corresponding plurality of terminals (7) slip fit in said terminal slots (4) from the front side (2) of the housing, each terminal (7) having a base (7*c*) with an engagement piece (16) stamped therein to be caught by a corresponding engagement slot (19) perpendicular to the terminal slot (4) characterized in that:

said engagement piece (16) is a metal strip cut away from the base (7*c*) of each terminal having a first and second surface in the form of flattened "V"-shaped cantilever arm, said engagement piece consisting of a first section (16) bent outward from a first surface of the terminal base extending a set distance from said first surface and a consecutive second section (21) integrally connected to and extending from a bent end (17) of said first section (16) through said terminal base (7*c*) beyond the second surface of the terminal base ending in a free end (18), said free end extending the same set distance from the second surface of the base as the bent end (17) extends from the first surface of the base; and said engagement slot (19) extending in a direction equal from both sides of the terminal slot (4), thereby enabling each terminal (4) to fixedly lie along the center line of the terminal slot with the bent end (17) and the free end (18) of the engagement piece (16) to fit in the engagement slot (19).

2. An electrical connector as set forth in claim 1 wherein said base has first and second portions (7*c*, 7*d*) extending in opposite directions, the first base portion (7*c*) having said engagement piece (16) stamped therein and the second base portion (7*d*) having a protrusion (9*b*) on its edge which is forced into the top portion of said terminal slot (4) thereby preventing the removal of the terminal out of said terminal sot (4).

3. An electrical connector as set forth in claim 2 wherein said terminal (4) has first and second contact arms (7*a*, 7*b*) extending from a center portion (14) of the base in opposite directions generally parallel to said base said first contact arm (*7a*) having a contact point (13) on its free end extending toward the first base portion (*7c*) for contacting a selected terminal or circuit path on a printed circuit board (10) and said second contact arm (*7b*) having a contact point (13') on its free end extending toward the second base portion (*7d*) for contacting a selected conductor of a flat flexible cable (11).

* * * * *